US012669047B1

(12) United States Patent
Brown et al.

(10) Patent No.: US 12,669,047 B1
(45) Date of Patent: Jun. 30, 2026

(54) ELECTRIC SUBMERSIBLE PUMP (ESP) TWO-PHASE PROCESSOR

(71) Applicant: Halliburton Energy Services, Inc., Houston, TX (US)

(72) Inventors: Donn J. Brown, Tulsa, OK (US); Laura Osorio Ojeda, Tulsa, OK (US); Trevor Alan Kopecky, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/265,686

(22) Filed: Jul. 10, 2025

(51) Int. Cl.
*E21B 43/38* (2006.01)
*E21B 43/12* (2006.01)

(52) U.S. Cl.
CPC ..... *E21B 43/38* (2013.01); *E21B 43/128* (2013.01)

(58) Field of Classification Search
CPC ..... E21B 43/38; E21B 43/128
See application file for complete search history.

(56) References Cited

U.S. PATENT DOCUMENTS 2,347,768 A * 5/1944 Crites ..... E21B 43/35 166/105.4
3,300,950 A * 1/1967 Carle ..... B01D 53/24 415/58.4
4,901,413 A * 2/1990 Cotherman ..... F04D 9/001 417/244
6,066,193 A * 5/2000 Lee ..... E21B 43/38 96/216
2011/0073305 A1* 3/2011 Morrison, III ..... E21B 43/38 166/265
2020/0141223 A1* 5/2020 Brown ..... E21B 43/121
2023/0010704 A1 1/2023 Sheth et al.
2023/0105823 A1* 4/2023 Brown ..... F04D 1/02 166/265
2023/0358129 A1* 11/2023 Brown ..... F04D 13/10
2024/0018855 A1 1/2024 Lu et al.
2024/0218767 A1 7/2024 Brown et al.
2025/0109681 A1* 4/2025 Ejim ..... E21B 47/008
2025/0122784 A1 4/2025 Stephens et al.

OTHER PUBLICATIONS

Foreign Communication from Related Application—International Search Report and Written Opinion of the International Searching Authority, International Application No. PCT/US2025/041613, dated Apr. 10, 2026, 13 pages.

* cited by examiner

*Primary Examiner* — D. Andrews
(74) *Attorney, Agent, or Firm* — Conley Rose, P.C.; Rodney B. Carroll

(57) ABSTRACT

An electric submersible pump (ESP) assembly. The ESP assembly comprises an electric motor having a first drive shaft; a seal unit having a second drive shaft coupled to the first drive shaft of the electric motor and disposed uphole of the electric motor; a first gas separator having a third drive shaft coupled to the second drive shaft and disposed uphole of the seal unit; a second gas separator having a fourth drive shaft coupled to the third drive shaft and disposed uphole of the first gas separator; a third gas separator having a fifth drive shaft coupled to the fourth drive shaft and disposed uphole of the second gas separator; and a centrifugal pump assembly having a sixth drive shaft coupled to the fifth drive shaft and disposed uphole of the third gas separator.

20 Claims, 13 Drawing Sheets

ELECTRIC SUBMERSIBLE PUMP (ESP) TWO-PHASE PROCESSOR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluids in a wellbore. Specifically, ESPs may be used to pump the production fluids to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the seal shaft. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP. To mitigate the undesirable effects of gas on the pump, one or more gas separators may be incorporated into the ESP between the fluid intake and the pump.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
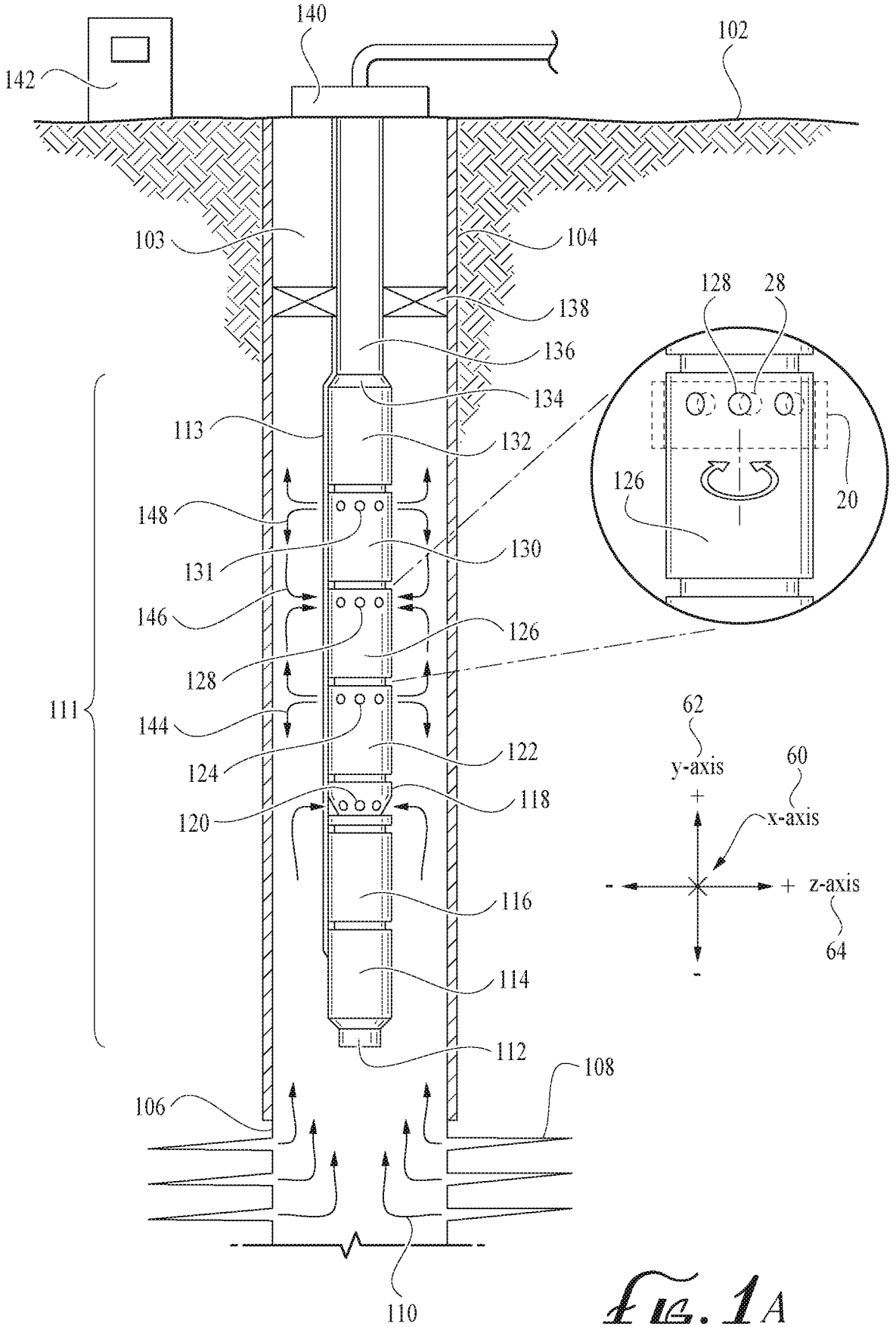
FIG. 1A is an illustration of an electric submersible pump (ESP) assembly according to an embodiment of the disclosure, showing fluids being produced from a substantially vertical portion of a wellbore.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," "down," "uphole," and "downhole" are defined relative to the net direction of flow of well fluid in the well casing, in the ESP assembly, and/or in the production tubing. In this regard, "downstream" will not be deemed to refer to the tortuous path of fluid as it flows through the internal passageways of components of the ESP assembly (for example, curving outwards away from a center axis of the pump while flowing through impeller passageways and curving inwards towards the center axis of the pump while flowing through diffuser passageways), but instead refers to the net direction of fluid flow through the components parallel to the center axis of the components. In a like sense, "upstream" will not be deemed to refer to the tortuous path of fluid as it flows through the internal passageways of components but the direction counter to the net direction of flow of well fluid through the components, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed in the "upstream" direction, while "Up" and "uphole" are directed in the "downstream" direction. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Gas entering a centrifugal pump of an electric submersible pump (ESP) assembly can cause various difficulties for a centrifugal pump. In an extreme case, the pump may become gas locked and become unable to pump fluid. In less extreme cases, the pump may experience harmful operating conditions when transiently passing a slug of gas. When in operation, the centrifugal pump rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the centrifugal pump may heat up rapidly and undergo significant wear, shortening the operational life of the centrifugal pump, thereby increasing operating costs due to more frequent change-out and/or repair of the centrifugal pump. Down time involved in repairing or replacing the centrifugal pump may also interrupt well production undesirably. In some operating environments, for example in some horizontal wellbores, gas slugs that persist for at least 10 seconds are repeatedly experienced. Some gas slugs may persist for as much as 30 seconds or more. The present disclosure teaches a new gas separator assembly that mitigates the effects of gas slugs.

The present disclosure teaches a gas handling stack disposed between the seal unit and the centrifugal pump assembly, where the gas handling stack includes three different gas separators. A first gas separator disposed uphole of the seal unit is a high-flow rate gas separator. A second gas separator disposed uphole of the first gas separator is a low-flow rate gas separator. A third gas separator disposed uphole of the second gas separator is a high-flow rate gas separator. It is thought that this particular arrangement of three gas separators of these different flow-rate capabilities can provide benefits in some downhole environments. In an embodiment, the first gas separator is rated to have a first fluid flow rate, the second gas separator is rated to have a second fluid flow rate, the third gas separator is rated to have a third fluid flow rate, and the second fluid flow rate is less than or equal to 85% of the first fluid flow rate and less than or equal to 85% of the third fluid flow rate. The fluid flow rate that a gas separator is configured to receive may be referred to as a nominal fluid flow rate of the gas separator and refers to the rate of fluid entering the gas separator at its downhole end. In an embodiment, the second gas separator is configured to receive a fluid flow rate at its inlet of less than 6,000 barrels per day and greater than 20 barrels per day (e.g., a 'low-flow rate'). In an embodiment, the high-flow first gas separator and the high-flow rate third gas separator are configured to receive a fluid flow rate at its inlet of more than 7,100 barrels per day and less than 50,000 barrels per day (e.g., a 'high-flow rate'). In an embodiment, the low-flow rate second gas separator is configured to receive a fluid flow rate that is between 30% and 85% of a nominal fluid flow rate of the first gas separator and between 30% and 85% of a nominal fluid flow rate of the third gas separator. It is understood that the nominal fluid flow rate of the first gas separator may be different from the nominal fluid flow rate of the third gas separator.

In an embodiment, the first gas separator comprises one or more internal fluid reservoirs not acting in the role of a separation chamber immediately downhole of the crossover of the first gas separator. These one or more internal fluid reservoirs in the first gas separator can provide a reserve supply of liquid fluid to mix with incoming gas during a transient gas slug arriving at the ESP assembly from the perforations in the wellbore, promoting continued provision of a pumpable fluid to the centrifugal pump assembly during the transient gas slug. In an embodiment, the third gas separator comprises a plurality of pump stages disposed uphole of the crossover of the third gas separator, promoting driving fluid across a narrow throat between the third gas separator and the inlet of the centrifugal pump assembly, whereby to maintain a high rate of fluid flow through the centrifugal pump assembly.

Figure 1B:
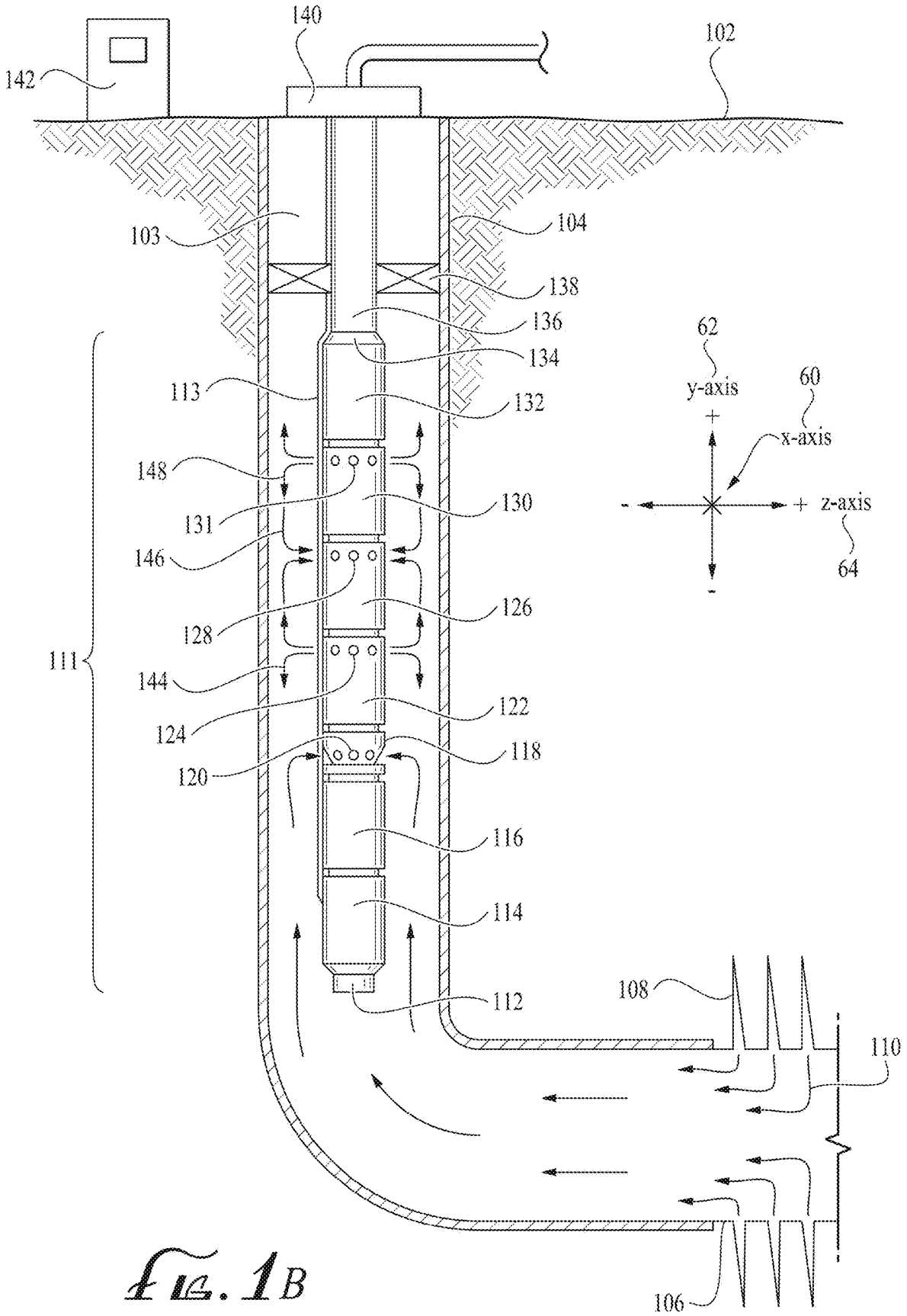
FIG. 1B is an illustration of an ESP assembly according to an embodiment of the disclosure, showing fluids being produced from a substantially horizontal portion of a wellbore.

Turning now to FIG. 1A and FIG. 1B, a well site environment, according to one or more aspects of the disclosure, is described. The production zone of FIG. 1A is illustrated as disposed in a substantially vertical portion or a wellbore, while the production zone of FIG. 1B is illustrated as disposed in a substantially horizontal portion of a wellbore. With the exception of these distinctions the well site environments and tools strings in FIG. 1A and FIG. 1B are substantially similar. In both FIG. 1A and FIG. 1B, a completion string is illustrated as disposed in a substantially vertical portion of a wellbore. It is understood, however, that in other embodiments the well site environment may be different. For example, in an embodiment, at least a portion of the completion string (e.g., the ESP assembly 111) may be disposed in a horizontal portion of a wellbore or in a diverted portion of the wellbore.

The well site environment comprises a wellbore 103 that is at least partially cased with casing 104. The well site environment may be at an on-shore location or at an off-shore location. The ESP assembly 111 in an embodiment comprises an optional sensor package 112, an electric motor 114, a seal unit 116, a fluid intake 118 having inlet ports 120, a first gas separator 122 having first gas phase discharge ports 124, a second gas separator 126 having second gas phase discharge ports 128, a third gas separator 130 having third gas phase discharge ports 131, a centrifugal pump assembly 132, and a discharge 134. In an embodiment, a sleeve 20 that defines apertures 28 may surround an outside of cross-over of the second gas separator 126. The discharge 134 fluidically couples an outlet of the centrifugal pump assembly 132 to a production tubing 136. An electric cable 113 may attach to the electric motor 114 and deliver electric power to the electric motor 114 from an electric power source 142 located at the surface 102. The production tubing 136 may be surmounted by a wellhead 140 that receives production fluid lifted by the centrifugal pump assembly 132 up the production tubing 136 to the surface 102. In an embodiment, a packer 138 may be installed to seal between the interior of the casing 104 and the production tubing 136. Installation of packers 138 may be required in some locations by public and/or governmental authorities. The packer 138 may prevent free gas in the wellbore 103 below the packer 138 rising to the surface and exiting the wellbore 103. In this case, free gas may accumulate below the packer 138 and interfere with operation of the centrifugal pump 132.

A lower portion 106 of the wellbore 103 may be open hole (e.g., not cased). The wellbore 103 may be serviced to produce perforations 108 in the wellbore 103 (e.g., either in the casing 104, if it extends through the producing formation, or in the open hole lower portion 106 of the wellbore 103). Reservoir fluid 110 may enter the wellbore 103 through the perforations 108. The reservoir fluid 110 flows uphole in the wellbore 103, past the optional sensor package 112, past the electric motor 114, past the seal unit 116, and into the fluid inlets 120 of the fluid intake 118. Note that in an embodiment, the fluid intake 118 may not be a separate component of the ESP assembly 111 but may be integrated into the downhole end of the first gas separator 122. During operation of the ESP assembly 111, the first gas separator 122 discharges fluid 144 out first gas phase discharge ports 124. The fluid 144 may be a mixture of gas phase fluid and liquid phase fluid. During operation of the ESP assembly 111, the second gas separator 126 may ingest or intake fluid 146 from the wellbore 103. The fluid 146 may be a mixture of gas phase fluid and liquid phase fluid. During operation of the ESP assembly 111, the third gas separator 130 discharges fluid 148 out third gas phase discharge ports 131. The fluid 148 may be a mixture of gas phase fluid and liquid phase fluid.

The reservoir fluid 110 may comprise a liquid phase fluid. The reservoir fluid 110 may comprise a gas phase fluid mixed with a liquid phase fluid. The reservoir fluid 110 may comprise only a gas phase fluid (e.g., simply a slug of gas). Over time, the gas to fluid ratio of the reservoir fluid 110 may change dramatically. For example, in a horizontal portion of the wellbore (e.g., the environment of FIG. 1B), gas may build up in high points in the roof of the wellbore 103 and after accumulating sufficiently may "burp" out of these high points and flow downstream to the ESP assembly 111 as what is commonly referred to as a gas slug. Thus, immediately before a gas slug arrives at the ESP assembly 111, the gas fluid ratio of the reservoir fluid 110 may be very low (e.g., the reservoir fluid 110 at the ESP assembly 111 is mostly liquid phase fluid); when the gas slug arrives at the ESP assembly 111, the gas fluid ratio is very high (e.g., the reservoir fluid 110 at the ESP assembly 111 is entirely or almost entirely gas phase fluid); and after the gas slug has passed the ESP assembly 111, the gas fluid ratio may again be very low (e.g., the reservoir fluid 110 at the ESP assembly 111 is mostly liquid phase fluid).

An orientation of the ESP assembly 111 is illustrated by an x-axis 60, a y-axis 62, and a z-axis 64. The several components of the ESP assembly 111 are substantially axially aligned with each other, although some flex and deviation from a perfect axial alignment may occur as the components flex in the wellbore 103, for example during run-in or in a final landing position resulting from a strain placed on the ESP assembly 111 by a curved portion of the wellbore 103 and/or a curved portion of the casing 104. Thus, the ESP assembly 111 may be bent slightly by such stress, but for purposes of discussion the components of the ESP assembly 111 share the same central axis.

Figure 1C:
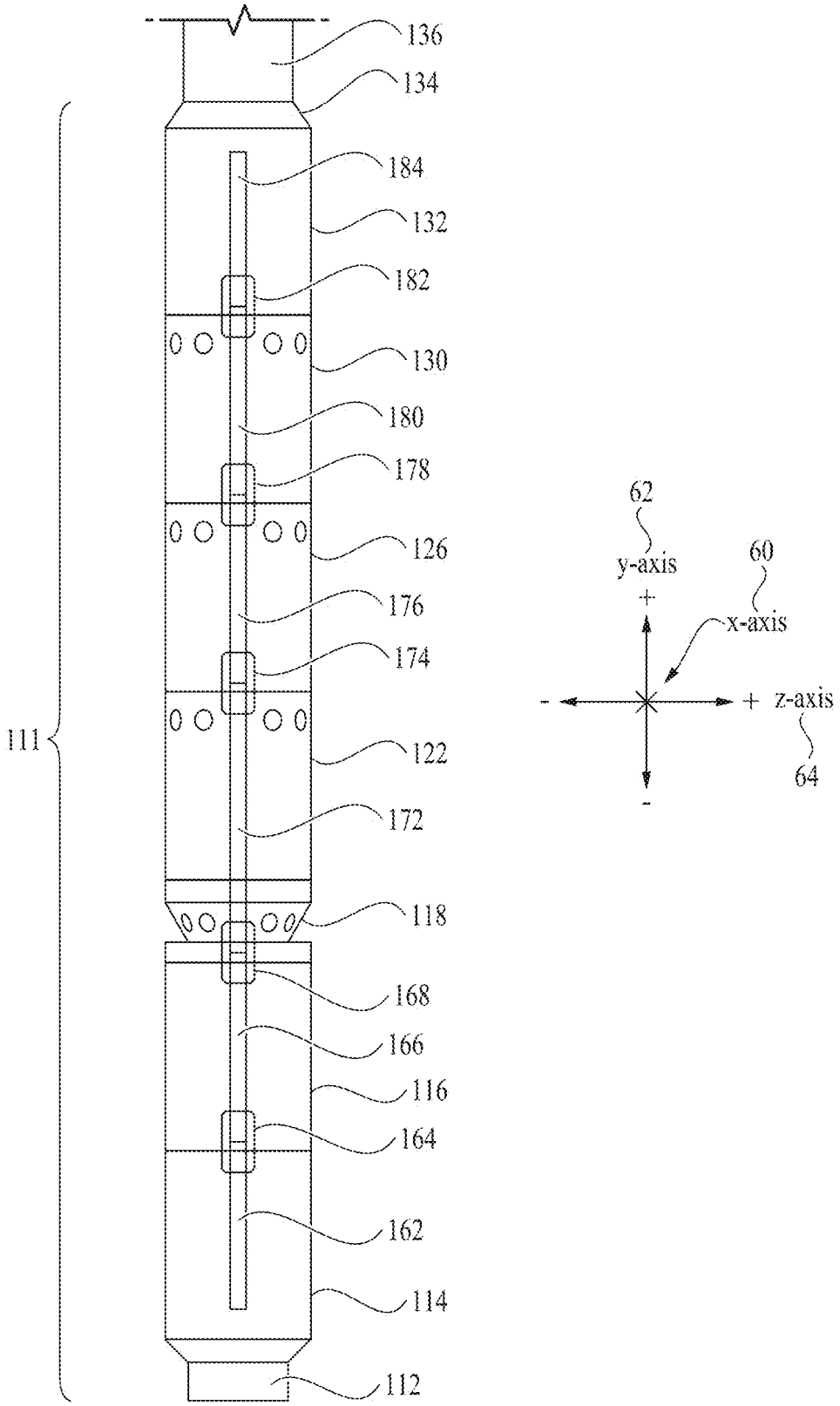
FIG. 1C is an illustration of an ESP assembly according to an embodiment of the disclosure, showing mechanical coupling among several drive shafts.

Turning now to FIG. 1C, the distribution of rotational power from the electric motor 114 to other components of the ESP assembly 111 is described. The electric motor comprises a first drive shaft 162. The seal unit comprises a second drive shaft 166 that is rotationally coupled to the first drive shaft 162 by a first coupling shell 164. The first gas separator 122 comprises a third drive shaft 172 that is rotationally coupled to the second drive shaft 166 by a second coupling shell 168. The second gas separator 126 comprises a fourth drive shaft 176 that is rotationally coupled to the third drive shaft 172 by a third coupling shell 174. The third gas separator 130 comprises a fifth drive shaft 180 that is rotationally coupled to the fourth drive shaft 176 by a fourth coupling shell 178. The centrifugal pump 132 comprises a sixth drive shaft 184 that is rotationally coupled to the fifth drive shaft 180 by a fifth coupling shell 182. When the electric motor 114 is provided with electric power via the electric cable 113, the electric motor 114 produces torque, turning the first drive shaft 162 and hence turning drive shafts 166, 172, 176, 180, and 184. This provides rotational power to each of the gas separators 122, 126, 130 and to the centrifugal pump assembly 132.

Figure 2A:
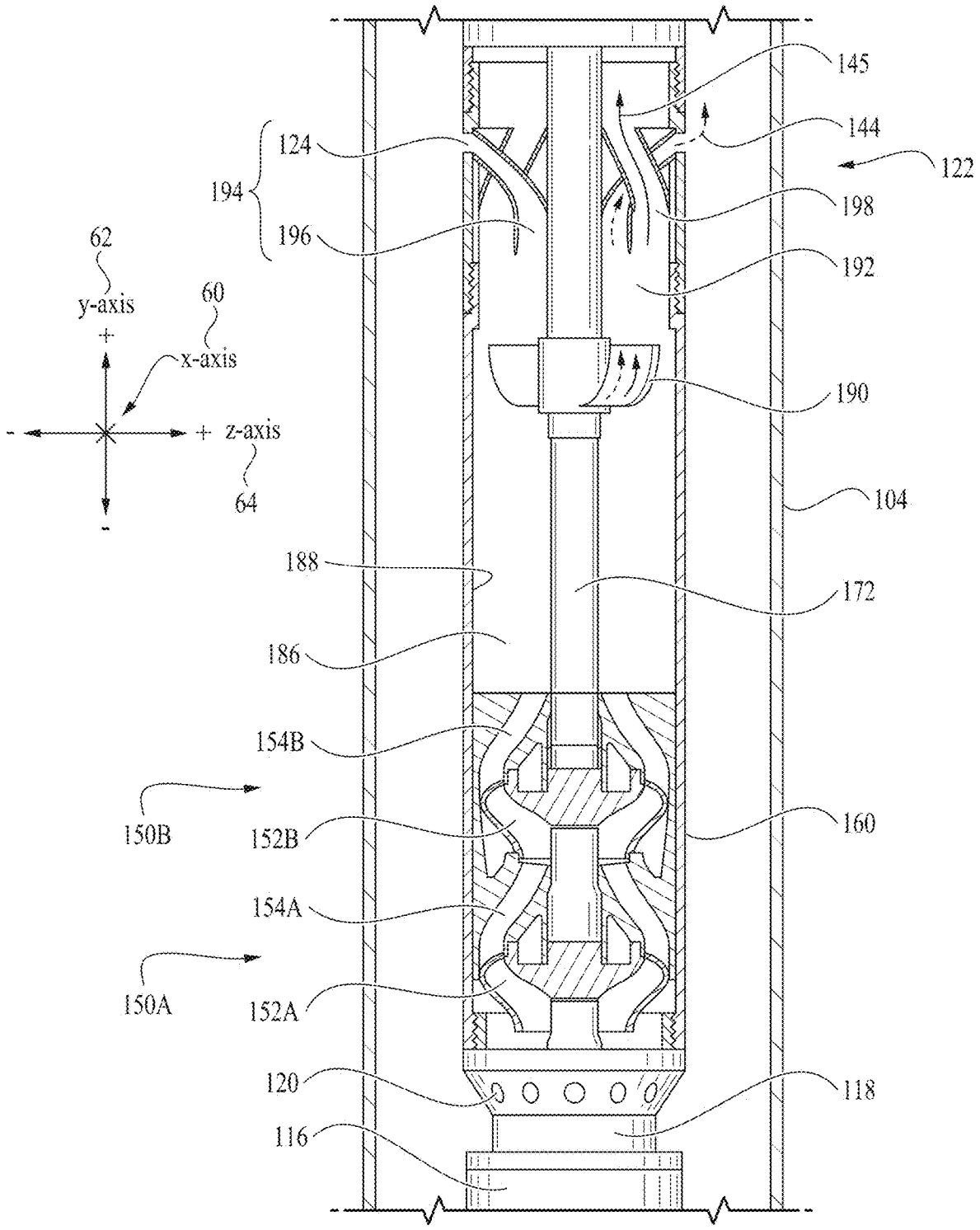
FIG. 2A is an illustration of a first gas separator according to an embodiment of the disclosure.

Turning now to FIG. 2A, further details of the first gas separator 122 are described. The first gas separator 122 is a high-flow gas separator and features one or more internal fluid reservoirs. The fluid reservoirs are thought to provide a reservoir of liquid fluid to mix with inflowing gas when a transient gas slug arrives at the inlet ports 120 of the fluid intake 118, so that the gas separators 122, 126, 130 can provide a pumpable fluid to the centrifugal pump assembly 132, even when a transient gas slug arrives at the ESP assembly 111. The pumpable fluid may comprise a significant fraction of gas, but if the gas phase fluid is incorporated as tiny gas bubbles within a surrounding envelope of liquid phase fluid (e.g., the gas is emulsified in liquid), the centrifugal pump assembly 132 may be able to pump the mix of tiny gas bubbles in the liquid phase fluid.

In an embodiment, the first gas separator 122 comprises the third drive shaft 172, a first pump stage 150A, a second pump stage 150B, a housing 160, a fluid reservoir 186, a paddle wheel 190, a separation chamber 192, and a first cross-over 194. The first pump stage 150A comprises a first impeller 152A mechanically coupled to the third drive shaft 172 and a first diffuser 154A retained by the housing 160. The second pump stage 150B comprises a second impeller 152B mechanically coupled to the third drive shaft 172 and a second diffuser 154B retained by the housing 160. It will be appreciated that the first gas separator 122 may comprise only a single pump stage downhole of the fluid reservoir 186. In an embodiment, the first gas separator 122 may comprise at least three pump stages and less than fifty pump stages disposed downhole of the fluid reservoir 186. In an embodiment, rather than pump stages disposed downhole of the fluid reservoir 186, the first gas separator 122 may comprise a statically positioned auger or a rotating auger (e.g., an auger mechanically coupled to and rotating with the third drive shaft 172).

In an embodiment, one or more pump stages, a statically positioned auger, or a rotating auger disposed downhole of the fluid reservoir 186 may be referred to as a first fluid mover and the paddle wheel 190 may be referred to as a second fluid mover. In an embodiment, the paddle wheel 190 may not be present in the first gas separator 122 and instead the place of the paddle wheel 190 may be filled by a statically positioned auger or a rotating auger disposed uphole of the fluid reservoir 186 and disposed downhole of the separation chamber 192. The function of the paddle wheel 190, or alternatively a statically positioned auger or a rotating auger, is to induce rotation in reservoir fluid 110 flowing through the first gas separator 122. Rotating the reservoir fluid 110 may induce a denser liquid phase fluid component 145 of the reservoir fluid 110 to separate from a less dense gas phase component 144 of the reservoir fluid 110, the liquid phase fluid component 145 may segregate, at least partially, from the gas phase fluid component 144. The gas phase fluid component 144 may tend to concentrate near and flow uphole proximate an outside of the third drive shaft 172 and flow into a gas phase flow passage 196 of the first crossover 194 and out the gas phase discharge ports 124 of the first crossover into the wellbore 103 outside of the ESP assembly 111. The liquid phase fluid component 145 may tend to flow along the inside of the housing 160 within the separation chamber and flow into the liquid phase flow passage 198 of the first crossover 194. The liquid phase fluid component 145 exits a liquid phase discharge port of the first crossover 194 and feeds uphole into the second gas separator 126. In an embodiment, an outside wall of the fluid reservoir 186 may be provided by a sleeve structure 188 disposed inside the housing 160. In another embodiment, however, the outside wall of the fluid reservoir 186 may be provided by the housing 160.

During normal operation, the reservoir fluid 110 may be primarily liquid phase fluid and have a low gas-to-liquid ratio. During such normal operation, the fluid reservoir 186 will fill with primarily liquid phase fluid. In the event that a gas slug develops in the wellbore 103 and the reservoir fluid 110 at the inlets 120 of the fluid intake is transiently all gas phase fluid or a very high gas-to-liquid ratio fluid, liquid phase, this gas will mix with the liquid phase fluid in the fluid reservoir 186, allowing at least some of the gas to be separated from the reservoir fluid 110 and exhausted out the first gas phase discharge ports 124 of the first crossover 194 of the first gas separator 122. When the transient gas slug has passed, the reservoir fluid 110 reaching the inlets 120 of the fluid intake 118 is again primarily liquid phase fluid (e.g., has a low gas-to-liquid ratio), and the fluid reservoir 186 refills with primarily liquid phase fluid.

Figure 2B:
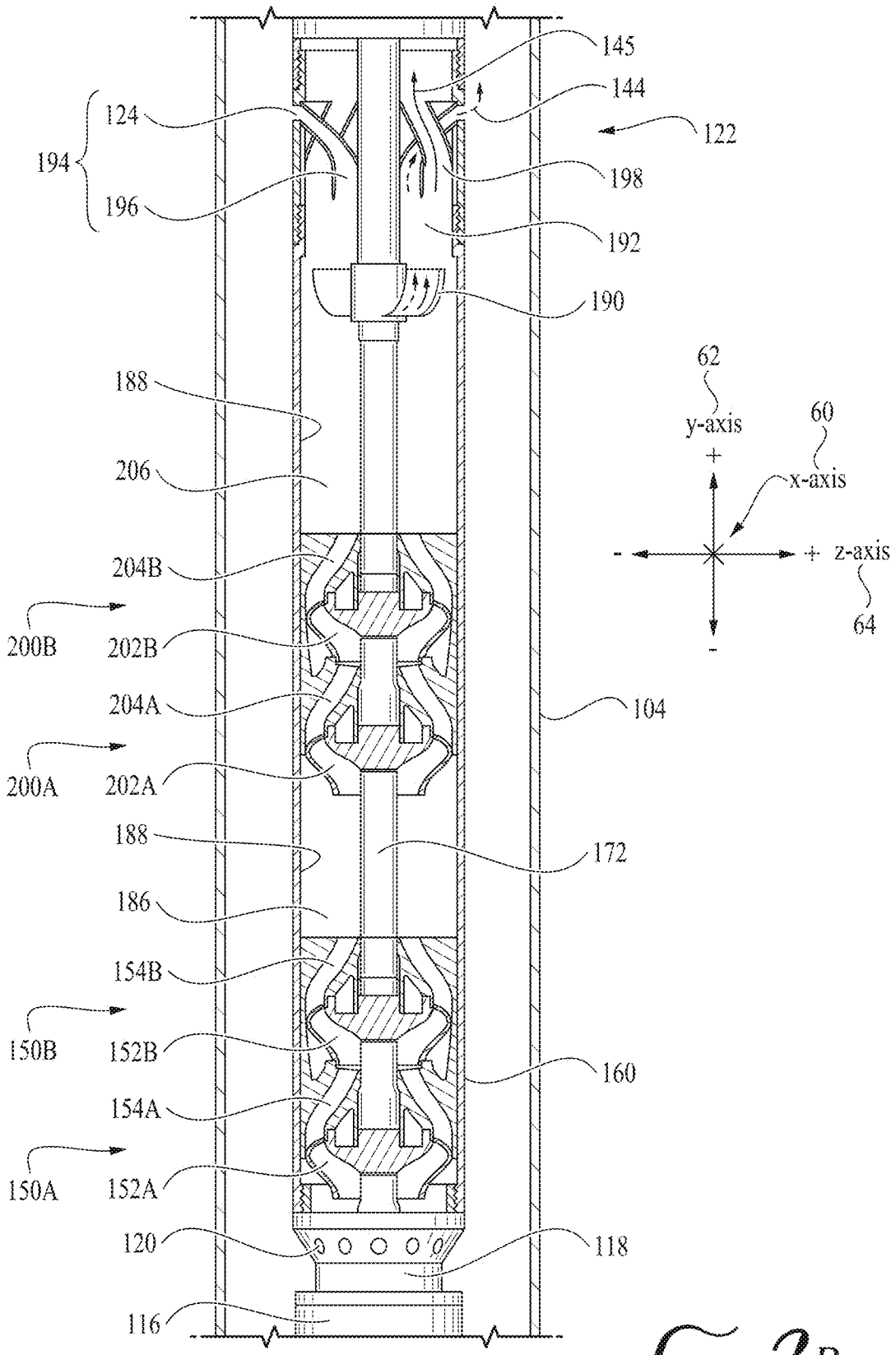
FIG. 2B is an illustration of the first gas separator according to another embodiment of the disclosure.

Turning now to FIG. 2B, another embodiment of the first gas separator 122 is described. The alternative embodiment of the first gas separator 122 illustrated in FIG. 2B has a first fluid reservoir 186 and a second fluid reservoir 206. The addition of the second fluid reservoir 206 may allow the first gas separator 122 to sustain a longer duration gas slug without totally running out of stored liquid phase fluid. The first gas separator 122 of FIG. 2B has a third pump stage 200A comprising a third impeller 202A mechanically coupled to the third drive shaft 172 and a third diffuser 204A retained by the housing 160 and a fourth pump stage 200B comprising a fourth impeller 202B mechanically coupled to the third drive shaft 172 and a fourth diffuser 204B retained by the housing 160. It will be appreciated that the first gas separator 122 may comprise any number of fluid reservoirs below the paddle wheel 190.

Figure 3:
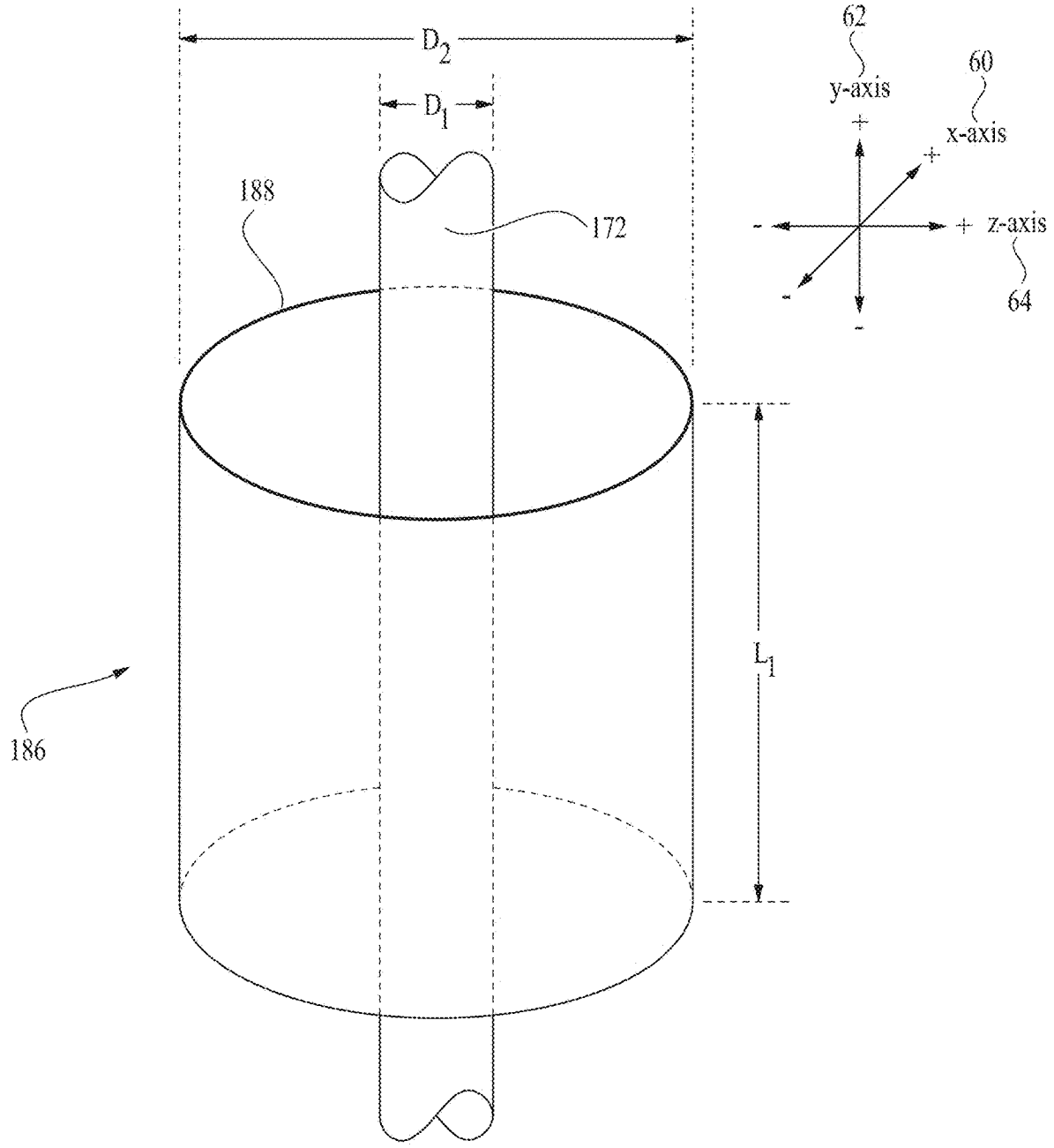
FIG. 3 is an illustration of a fluid reservoir according to an embodiment of the disclosure.
Figure 4A:
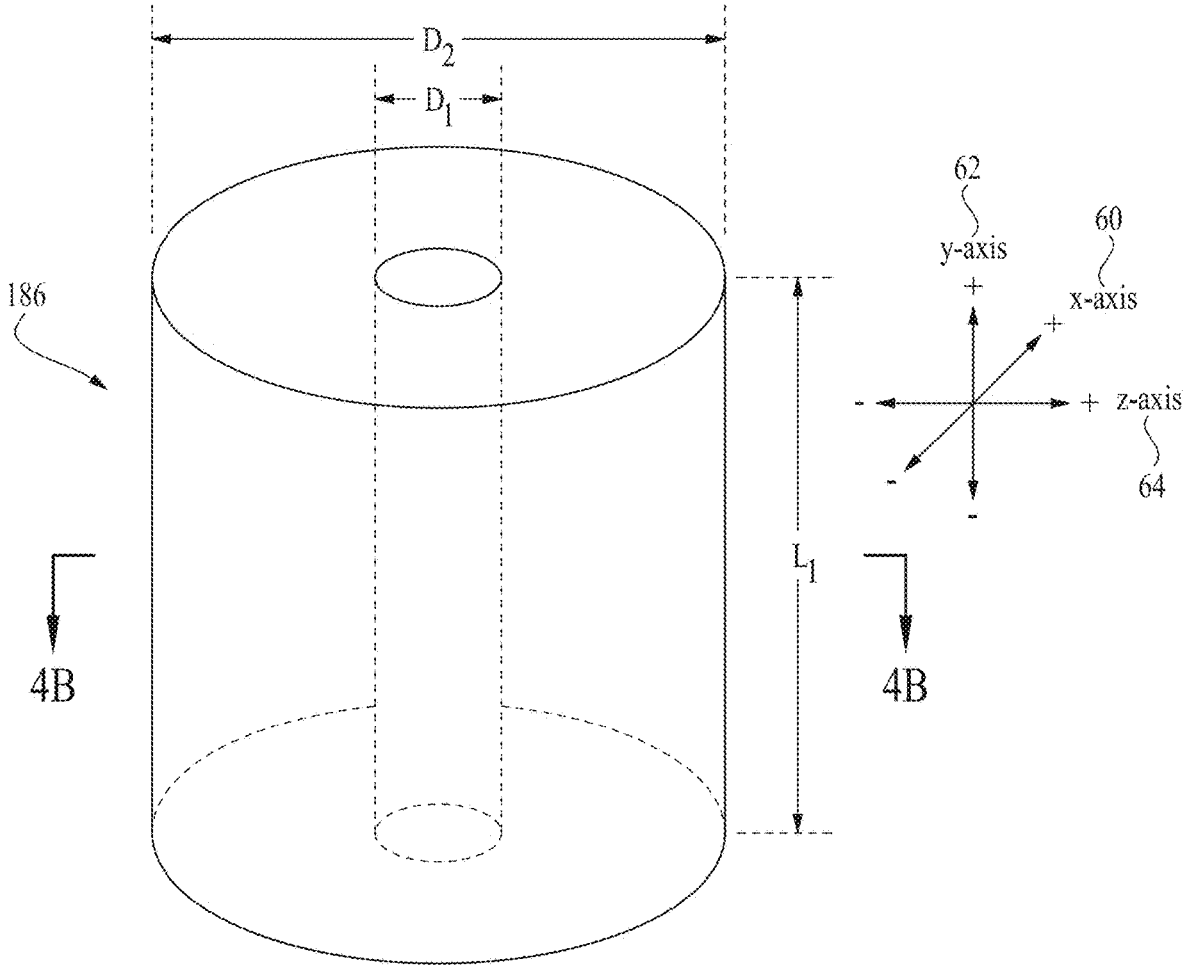
FIG. 4A and FIG. 4B are illustrations of a geometric model of the fluid reservoir according to an embodiment of the disclosure.
Figure 4B:
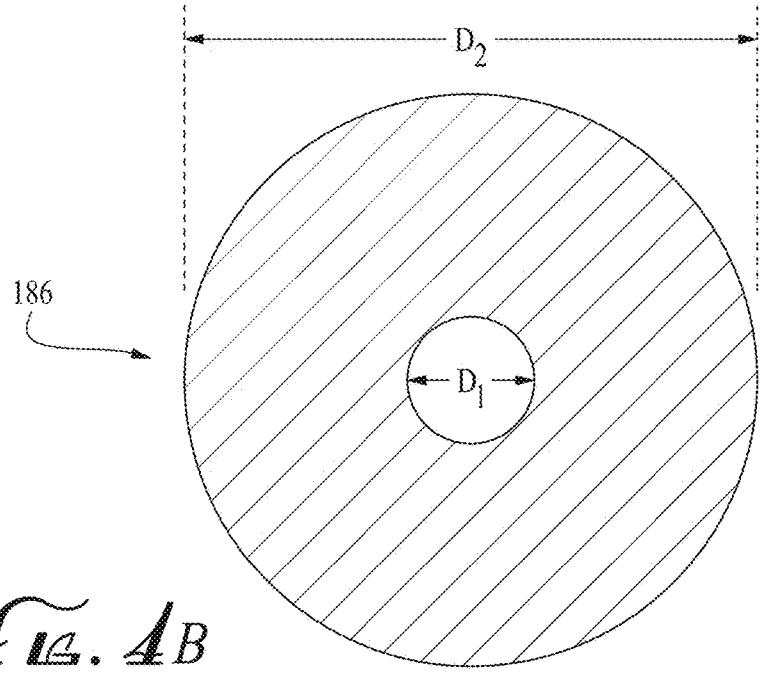

Turning now to FIG. 3, the fluid reservoir 186 is illustrated as an annulus defined between the drive shaft 172 and the inner surface 188 (e.g., the inner wall of the housing 160 or a sleeve inside the inner wall of the housing 160). The annular volume of the annulus defined by the fluid reservoir is shown better in FIG. 4A and FIG. 4B. The volume may be found as the cross-sectional area of the annular volume (best seen in FIG. 4B) multiplied by the length of the fluid reservoir 186 indicated as 'L1' in FIG. 3 and in FIG. 4A. The cross-sectional area of the annular volume can be found as the difference of the area of a circle of diameter D2 (the inside diameter of the housing 160 or the inside diameter of the sleeve) and the area of a circle of diameter D1 (the diameter of the third drive shaft 172). By increasing the sum volume of fluid reservoirs inside the first gas separator 122, the gas separator 122 is able to sustain gas slugs of increasing duration.

In an embodiment, the fluid reservoir 186 is at least 2 inches long and less than 14 inches long. In an embodiment, the fluid reservoir 186 is at least 6 inches long and less than 14 inches long. In an embodiment, the fluid reservoir 186 is at least 14 inches long and less than 28 inches long. In an embodiment, the fluid reservoir 186 is at least 17 inches long and less than 34 inches long. In an embodiment, the fluid reservoir 186 is at least 24 inches long and less than 42 inches long. In an embodiment, the annular volume of the fluid reservoir 186 is at least 18 cubic inches and less than 1000 cubic inches. In an embodiment, the annular volume of the fluid reservoir 186 is at least 50 cubic inches and less than 1000 cubic inches. In an embodiment, the fluid reservoir 186 may comprise one or more spider bearings to support the drive shaft 172 as discussed further hereinafter.

In an embodiment, the first gas separator 122 may be less than 500 feet long and at least, 5 feet long, at least 8 feet long, at least 10 feet long, at least 12 feet long, at least 14 feet long, at least 16 feet long, at least 18 feet long, at least 20 feet long, at least 22 feet long, at least 24 feet long, at least 26 feet long, at least 28 feet long, at least 30 feet long, at least 32 feet long, at least 34 feet long, at least 40 feet long, at least 50 feet long, at least 60 feet long, at least 70 feet long, at least 80 feet long, at least 90 feet long, at least 100 feet long, at least 120 feet long, or at least 140 feet long. In embodiments in which the first gas separator 122 is very long, the first gas separator 122 may comprise a first housing that threadingly couples with a second housing, and the first housing and second housing joined together contain the internal components of the first gas separator 122 and the third drive shaft 172 may comprise two drive shafts that are coupled together by a spline coupling.

Figure 5A:
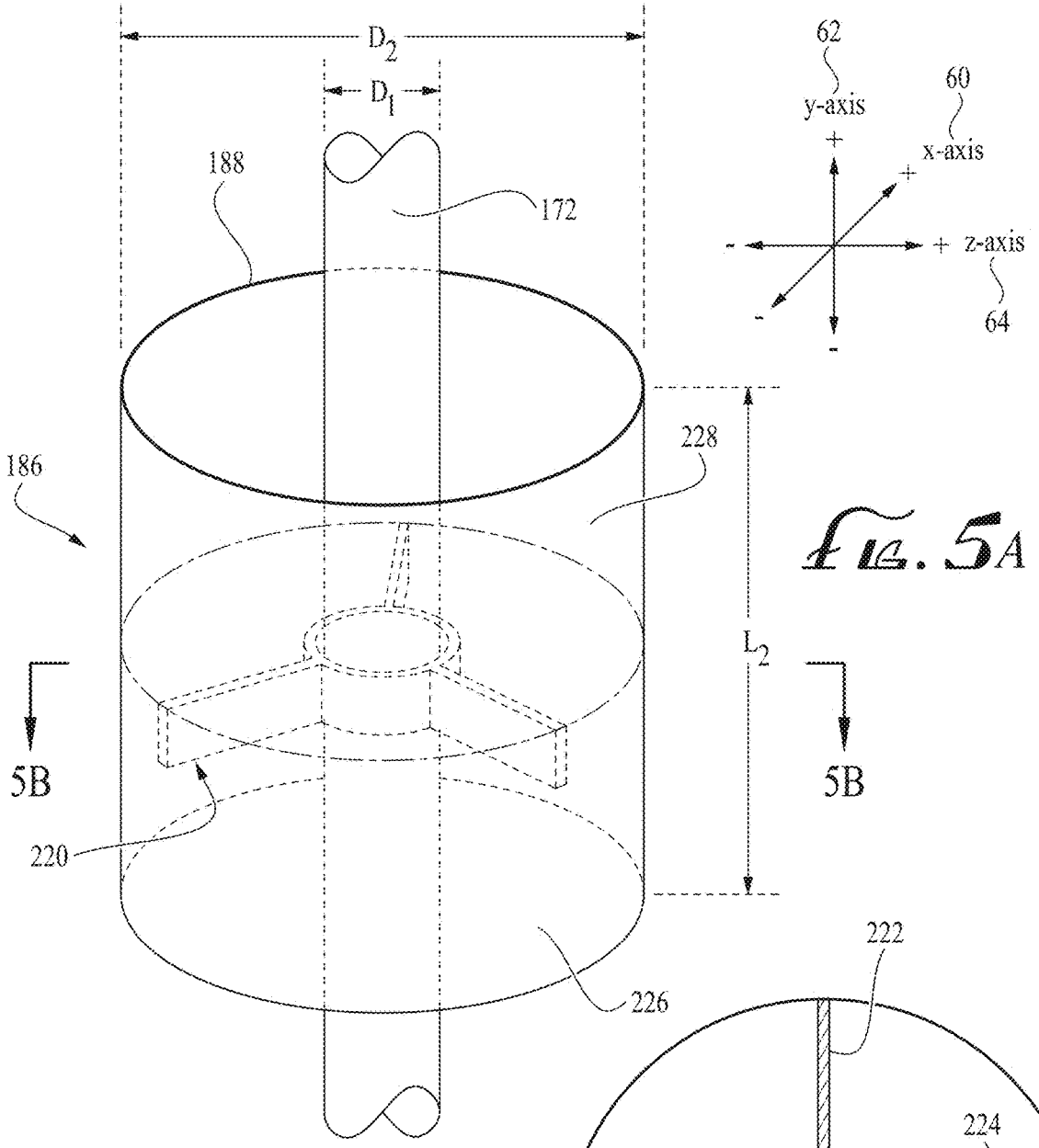
FIG. 5A, FIG. 5B, and FIG. 5C are illustrations of one or more spider bearings disposed within the fluid reservoir according to an embodiment of the disclosure.
Figure 5B:
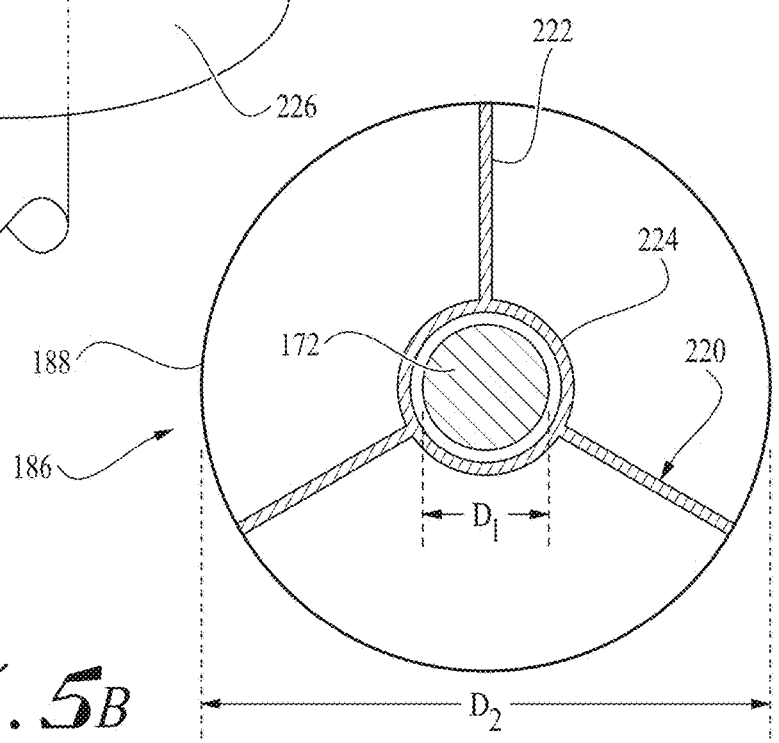
Figure 5C:
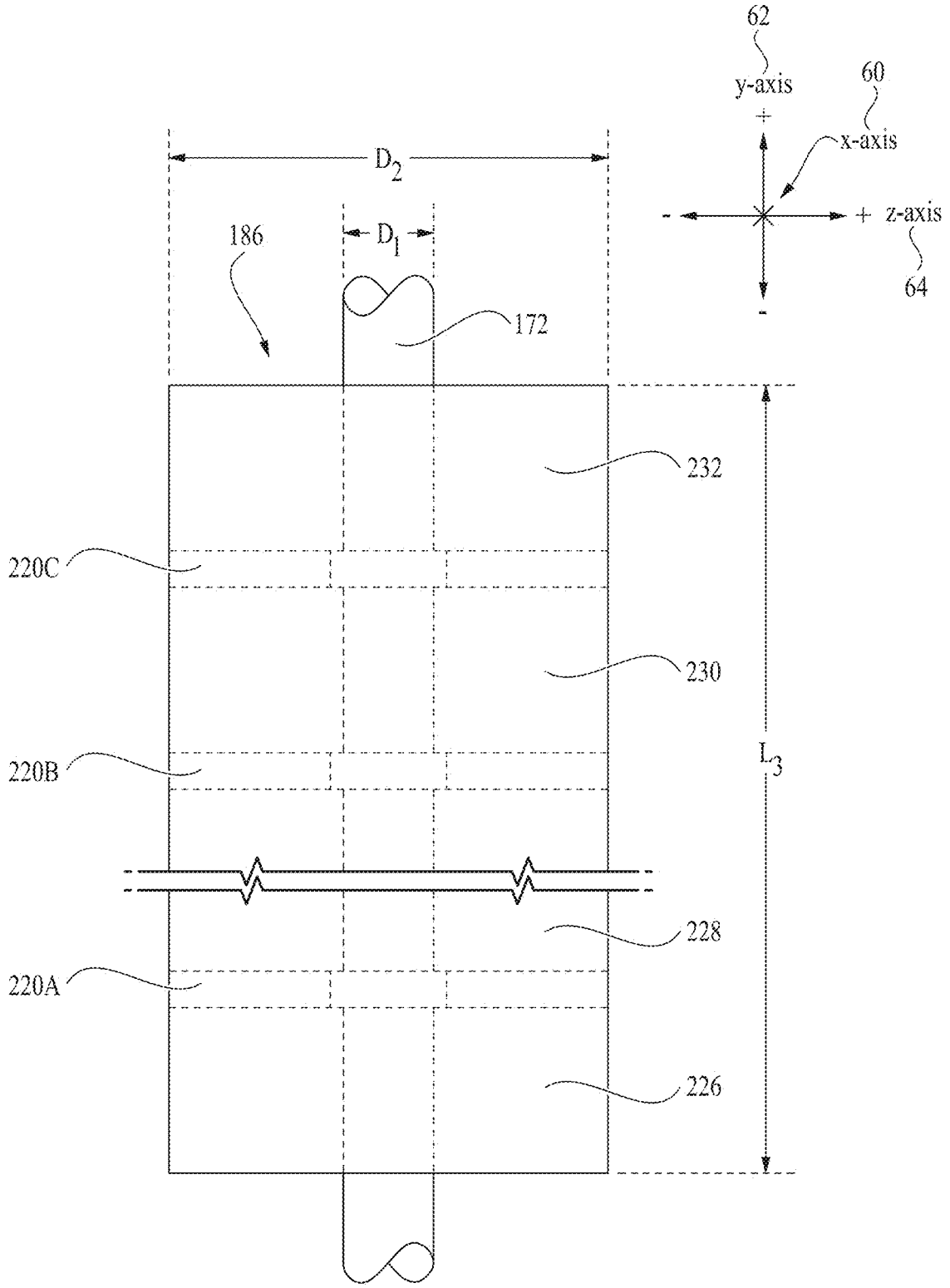

Turning now to FIG. 5A, a spider bearing 220 is illustrated in about a middle of the length L2 of the fluid reservoir 186. By supporting the drive shaft 172 in a middle portion, the length L2 can be made greater, for example can be increased to 16 inches, 18 inches, 20 inches, 22 inches, 24 inches, 26 inches, or 28 inches. The use of spider bearings 220 can readily increase the sum of volumes of fluid reservoir 186 within the first gas separator 122. In FIG. 5B a different view of the spider bearing 220 is illustrated. The spider bearing 220 may comprise three struts 222 or vanes that stabilize a central bearing 224 or hub of the spider bearing 222. The struts 222 may be secured by the housing 160. The struts 222 may take a shape of vanes oriented so as to minimally block the communication of reservoir fluid 110 through the spider bearing 220, between the struts 222. Alternatively, the struts 222 may be angled, whereby to induce a rotation in the reservoir fluid 110 as it flows through the first gas separator 122. The spider bearing 220 provides fluid communication paths between the struts 222. While FIG. 5A and FIG. 5B illustrate a spider bearing 220 with three struts 222, the spider bearings 220 may comprise two struts, four struts, five struts, or some greater number of struts 222. In FIG. 50, the number of spider bearings 220 may be increased to any number, thereby increasing the volume annular volume defined by the fluid reservoir 186, 174, 176. As shown in FIG. 50, three spider bearings 220*a*, 220*b*, 220*c* are used and may provide a length L3 of the fluid reservoir 186 via annular regions 226, 228, 230, and 232 of 24 inches, 32, inches, 40 inches, 44 inches, 48 inches, 52 inches, or 56 inches.

In an embodiment, the drive shaft 172 has an outside diameter of about ⅞ inches (e.g., about 0.875 inches), and the first gas separator assembly 122 has an outside diameter of about 4 inches. In this case, the inside diameter of the housing 160 or of the sleeve inside the inner wall of the housing 160 is about 3½ inches (e.g., 3.5 inches). These dimensions give a D1 value of about 0.875 inches, a D2 value of about 3.5 inches. The area of the cross-section in FIG. 4B for these values of D1 and D2 can be calculated to be about 9.0198 square inches. A corresponding annular volume can be calculated for a plurality of different values for L1 as per below:

| Value of L1 | Corresponding annular volume |
|---|---|
| 2" | 18.040 cubic inches |
| 4" | 36.079 cubic inches |
| 6" | 54.119 cubic inches |
| 8" | 72.158 cubic inches |
| 10" | 90.198 cubic inches |
| 12" | 108.24 cubic inches |
| 14" | 126.28 cubic inches |

In an embodiment, the drive shaft 172 has an outside diameter of about 11/16 inches (e.g., about 0.6875 inches), and the first gas separator assembly 122 has an outside diameter of about 4 inches. In this case, the inside diameter of the housing 160 or of the sleeve inside the inner wall of the housing 160 is about 3½ inches (e.g., 3.5 inches). The area of the cross-section in FIG. 4B for these values of D1 and D2 can be calculated to be about 9.2499 square inches. A corresponding annular volume can be calculated for a plurality of different values for L1 as per below:

| Value of L1 | Corresponding annular volume |
|---|---|
| 2" | 18.500 cubic inches |
| 4' | 37.000 cubic inches |
| 6" | 55.499 cubic inches |
| 8" | 73.999 cubic inches |
| 10" | 92.499 cubic inches |
| 12" | 111.00 cubic inches |
| 14" | 129.50 cubic inches |

In an embodiment, the drive shaft 172 has an outside diameter of about 1 3/16 inches (e.g., about 1.1875 inches), and the first gas separator assembly 122 has an outside diameter of about 5.38 inches. In this case, the inside diameter of the housing 160 or of the sleeve inside the inner wall of the housing 160 is about 4.77 inches. The area of the cross-section in FIG. 4B for these values of D1 and D2 can be calculated to be about 16.763 square inches. A corresponding annular volume can be calculated for a plurality of different values for L1 as per below:

| Value of L1 | Corresponding annular volume |
|---|---|
| 2" | 33.526 cubic inches |
| 4" | 67.052 cubic inches |
| 6" | 100.58 cubic inches |
| 8" | 134.10 cubic inches |
| 10" | 167.63 cubic inches |
| 12" | 201.16 cubic inches |
| 14" | 234.68 cubic inches |

In an embodiment, the drive shaft 172 has an outside diameter of about 1 inch, and the first gas separator 122 has an outside diameter of about 5.38 inches. In this case, the inside diameter of the housing 160 or of the sleeve inside the inner wall of the housing 160 is about 4.77 inches. The area of the cross-section in FIG. 4B for these values of D1 and D2 can be calculated to be about 17.085 square inches. A corresponding annular volume can be calculated for a plurality of different values for L1 as per below:

| Value of L1 | Corresponding annular volume |
|---|---|
| 2" | 34.170 cubic inches |
| 4" | 68.340 cubic inches |
| 6" | 102.51 cubic inches |

-continued

| Value of L1 | Corresponding annular volume |
|---|---|
| 8" | 136.68 cubic inches |
| 10" | 170.85 cubic inches |
| 12" | 205.02 cubic inches |
| 14" | 239.19 cubic inches |

The diameter of the drive shaft 172 and the inside diameter of the housing 160 or sleeve may be determined by the wellbore environment the ESP assembly 111 may be deployed to. By varying the length L1, however, more or less annular volume may be created in the fluid reservoir 186. More annular volume provides further buffer or reserve against gas slugs. At the same time, the length L1 may not be increased indefinitely because the drive shaft 172 may be unsupported and unstabilized in the fluid reservoir 186. In an embodiment, this length L1 may desirably be restricted to less than 16 inches, less than 15 inches, less than 14 inches, less than 13 inches, less than 12 inches, less than 11 inches, or less than 10 inches. The maximum prudent length of L1 depends upon the diameter of the drive shaft 172—the value of D1. A greater diameter drive shaft 172 may allow a relatively larger maximum length of L1 while a smaller diameter drive shaft 172 may allow a relatively smaller maximum length of L1. Greater annular volume—and hence greater ability to sustain gas slugs of long duration—can be provided either by increasing the length L1 or by increasing the number of fluid reservoirs within the first gas separator 122. Greater annular volume can be provided by increasing the length L1 by adding spider bearings 220 and desirable intervals within a single fluid reservoir to maintain the desired stability and support for the drive shaft 172.

It is noted that the substantial open volumes between centrifugal pump stages and a stationary auger taught herein are not conventionally included in gas separator assemblies because additional materials are required to do this (longer housing 160, for example), and longer spans where the drive shaft 172 is not supported occur.

Figure 6:
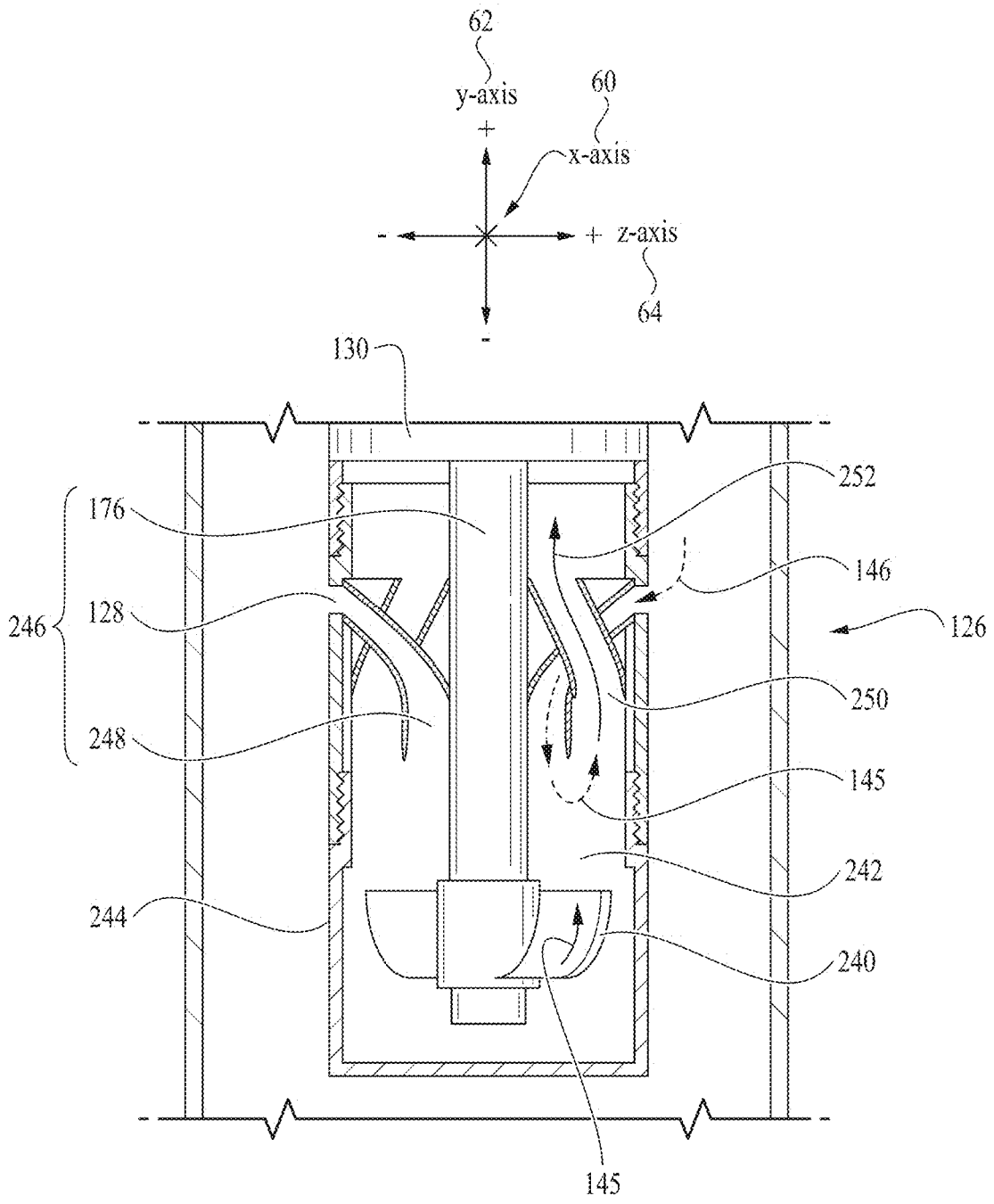
FIG. 6 is an illustration of a second gas separator according to an embodiment of the disclosure.

Turning now to FIG. 6, further details of the second gas separator 126 are described. In an embodiment, the second gas separator 126 comprises the fourth drive shaft 176, a paddle wheel 240, a separation chamber 242, a housing 244, and a second crossover 246. The second crossover 246 defines a second gas phase fluid flow passage 248 having a second gas phase discharge port 128 and a liquid phase fluid flow passage 250. It is understood that the name of the second gas phase fluid flow passage 248 is conventional. In operation, it is expected that the gas phase fluid flow passage 248 may ingest gas phase fluid 146 and/or liquid phase fluid from the wellbore 103. This ingested gas phase fluid 146 may mix with fluid flow 145 fed uphole by the first gas separator 122, and the combined gas phase fluid 146 and fluid flow 145 may flow up the liquid phase fluid flow passage 250 as fluid 252 to an outlet of the second gas separator 126 and into an inlet of the third gas separator 130.

The second gas separator 126 is configured as a low-flow rate gas separator and may have a flow rate of between 20 barrels per day to 5,800 barrels per day. In an embodiment, the second gas separator 126 is configured to have a flow rate of between 30% and 85% of the nominal flow rate of the first gas separator 122 and between 30% and 85% of the nominal flow rate of the third gas separator 130. In an embodiment, the low-flow rate of the second gas separator 126 may be the result of not including any pressure generating fluid movers (e.g., the paddle wheel 240 doesn't build substantial hydraulic head), and in the absence of the forcing impetus of pressure generating fluid movers, the flow rate of the second gas separator 126 is relatively a low-flow rate. The second gas separator 126 may include a low number of pump stages downhole of the paddlewheel 240 or the second gas separator 126 may include a plurality of pump stages downhole of the paddlewheel 240 that reduce the flow rate (e.g., because the pump stages are configured to provide a low nominal flow rate). Alternatively, in an embodiment, an inlet of the second gas separator 126 may comprise a throttling plate or a choke that restricts a cross-sectional area of the inlet, whereby to reduce the rate of fluid flow into the second gas separator 126.

In an embodiment, the gas phase discharge ports 128 of the second crossover 246 are adjustable so the cross-sectional flow area of the gas phase discharge ports 128 can be reduced or increased. This ability to adjust the cross-sectional flow area of the gas phase discharge ports 128 can adjust the rate at which gas phase fluid and/or liquid phase fluid is ingested into the second gas separator 126 via the gas phase discharge ports 128 and into the second gas separator 126 from the wellbore 103. For example, as illustrated in FIG. 1A, a sleeve 20 may surround an outside of the second crossover 246, wherein the sleeve 20 defines apertures 28 that can be aligned with the gas phase discharge ports 128. By aligning or misaligning such apertures in the sleeve 20, the cross-sectional area of the gas phase discharge ports 128 can be increased or decreased.

Figure 7:
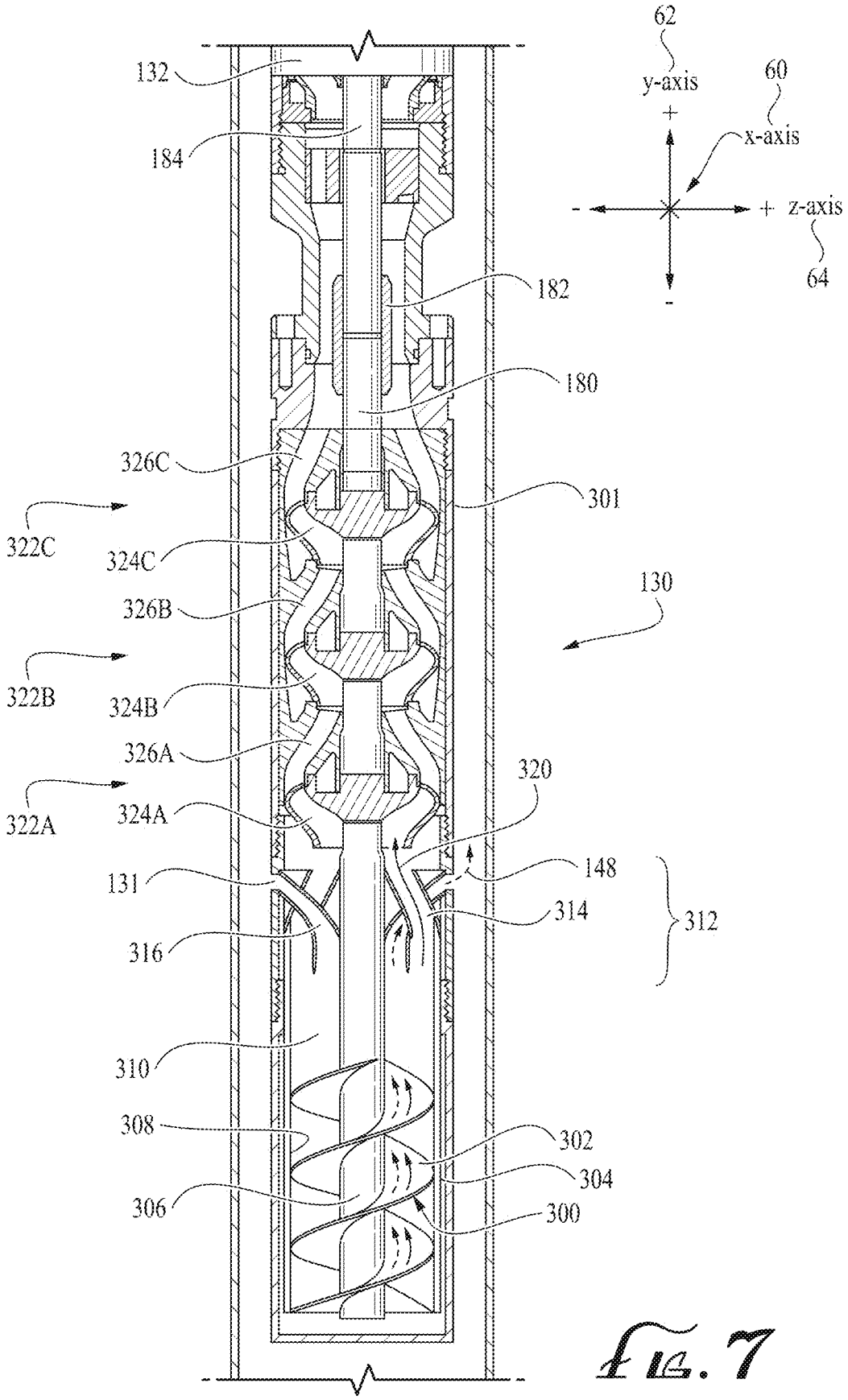
FIG. 7 is an illustration of a third gas separator according to an embodiment of the disclosure.

Turning now to FIG. 7, further details of the third gas separator 130 are described. The third gas separator 130 is a high-flow rate gas separator. In an embodiment, the third gas separator 130 comprises the fifth drive shaft 180, an auger 300 having one or more helical vanes 302, and an optional central shaft 306. The helical vanes 302 may be coupled to the optional central shaft 306 or the helical vanes 302 may define a hollow center without the optional central shaft 306. In an embodiment, the auger 300 may be statically disposed. In another embodiment, the auger 300 may be a rotating auger mechanically coupled to the fifth drive shaft 180. In an embodiment, the auger 300 may be disposed inside of a sleeve 304, and the sleeve 304 may be retained by a housing 301 of the third gas separator 130. In an embodiment, instead of the auger 300, a plurality of centrifugal pump stages are disposed below the separation chamber 310, where each centrifugal pump stage comprises an impeller mechanically coupled to the fifth drive shaft 180 and a diffuser retained by a housing of the third gas separator 130.

The third gas separator 130 further comprises a separation chamber 310, a crossover 312, and a plurality of centrifugal pump stages 322. The crossover 312 defines a liquid phase flow passage 314 and a gas phase flow passage 316. The centrifugal pump stages may comprise a first centrifugal pump stage 322A having a first impeller 324A mechanically coupled to the fifth drive shaft 180 and a first diffuser 326A retained by the housing 301; a second centrifugal pump stage 322B having a second impeller 324B mechanically coupled to the fifth drive shaft 180 and a second diffuser 326B retained by the housing 301; and a third centrifugal pump stage 322C having a third impeller 324C mechanically coupled to the fifth drive shaft 180 and a third diffuser 326C retained by the housing 301. It is understood that the third gas separator 130 may have a different pump configuration disposed uphole of the crossover 312, for example a single centrifugal pump stage, two centrifugal pump stages, four centrifugal pump stages, five centrifugal pump stages, six centrifugal pump stages, seven centrifugal pump stages, eight centrifugal pump stages, nine centrifugal pump stages, ten centrifugal pump stages, or greater than ten centrifugal pump stages and less than thirty centrifugal pump stages. The centrifugal pump of the third gas separator disposed uphole of the crossover 312 provides impetus to fluid 320 to maintain a high rate of fluid flow via a narrow throat between the third gas separator and the centrifugal pump assembly 132, for example a narrow throat formed between the fifth coupling shell 182 and an inside of a base of the centrifugal pump assembly 132.

Reservoir fluid flowing into an inlet of the third gas separator 130 (e.g., fluid 252 described with reference to FIG. 6 above) flows through the auger 300 and is induced to rotate within the separation chamber 310. A gas phase fluid component may segregate from a liquid phase fluid component of the reservoir fluid within the separation chamber 310, the liquid phase fluid component may be disposed near an outside of the separation chamber 310, proximate the inside of the housing 301, and the gas phase fluid component may be disposed near a center of the separation chamber 310, proximate the outside surface of the fifth drive shaft 180. The gas phase fluid component may enter the gas phase flow passage 316 and exit the third gas separator 130 via the third gas phase discharge ports 131 into the wellbore 103. The liquid phase fluid component may enter the liquid phase flow passage 314 and flow as fluid flow 320 to centrifugal pump stages of the third gas separator 130 disposed uphole of the crossover 312. The fluid flow 320 enters the centrifugal pump stages and are forced through the narrow throat between the third gas separator 130 and the centrifugal pump assembly 132. The centrifugal pump assembly 132 comprises a plurality of centrifugal pump stages, where each centrifugal pump stage comprises an impeller mechanically coupled to the sixth drive shaft 184 and a diffuser retained by a housing of the centrifugal pump assembly 132. In embodiment, the centrifugal pump assembly 132 comprises between one centrifugal pump stage and three hundred centrifugal pump stages.

Figure 8:
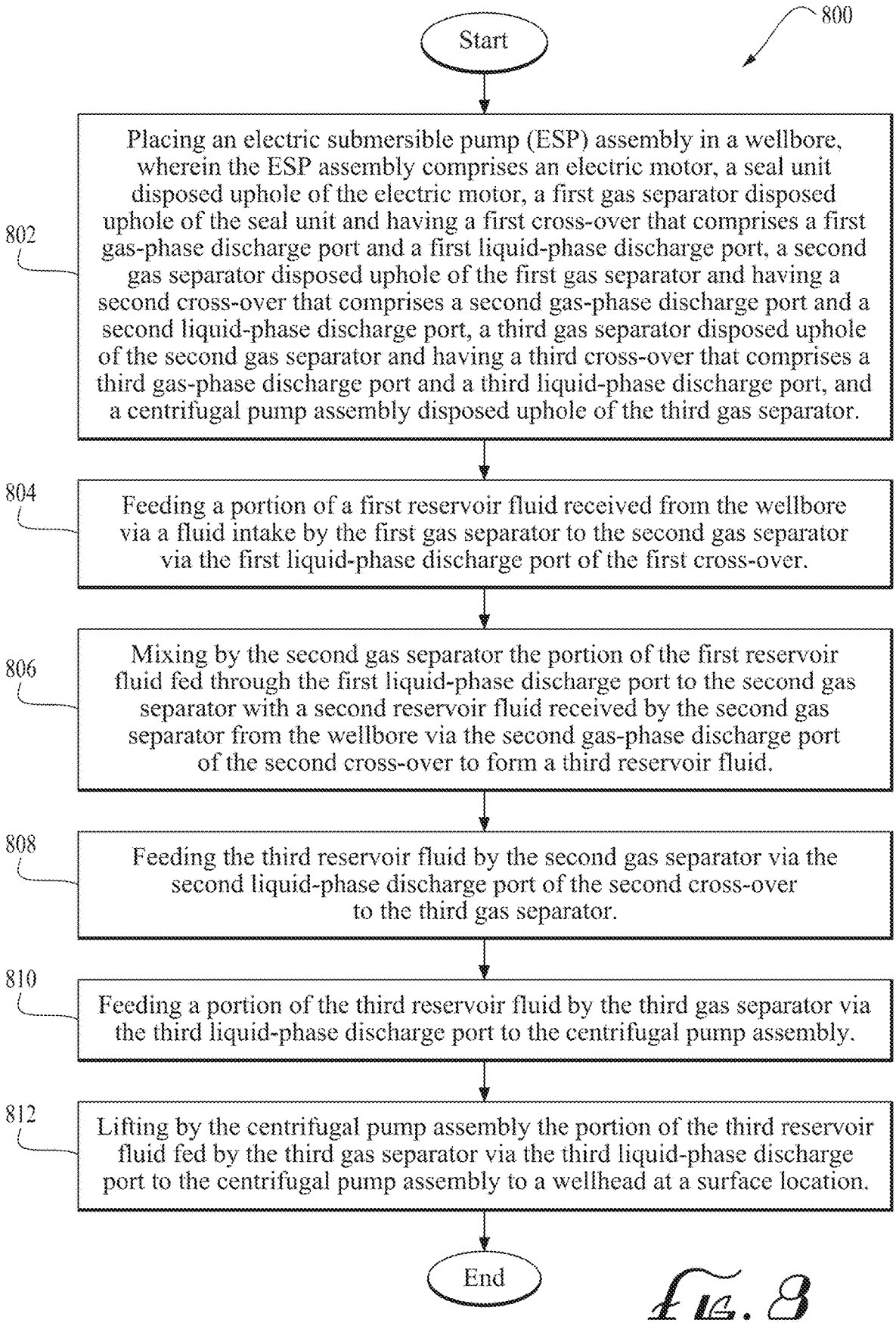
FIG. 8 is a flow chart of a method according to an embodiment of the disclosure.

Turning now to FIG. 8, a method 800 is described. In an embodiment, the method 800 is a method of lifting reservoir fluid by an electric submersible pump (ESP) assembly. At block 802, the method 800 comprises placing an electric submersible pump (ESP) assembly in a wellbore, wherein the ESP assembly comprises an electric motor, a seal unit disposed uphole of the electric motor, a first gas separator disposed uphole of the seal unit and having a first cross-over that comprises a first gas-phase discharge port and a first liquid-phase discharge port, a second gas separator disposed uphole of the first gas separator and having a second cross-over that comprises a second gas-phase discharge port and a second liquid-phase discharge port, a third gas separator disposed uphole of the second gas separator and having a third cross-over that comprises a third gas-phase discharge port and a third liquid-phase discharge port, and a centrifugal pump assembly disposed uphole of the third gas separator. In an embodiment, placing the ESP assembly in the wellbore comprises lowering the ESP assembly into the wellbore by a production tubing that connects to a discharge disposed at an uphole end of the centrifugal pump, further comprising setting a packer in the wellbore, wherein the packer seals against an inside of the wellbore and against an outside of the production tubing. In an embodiment, the second gas-phase discharge port of the second cross-over is adjustable.

At block 804, the method 800 comprises feeding a portion of a first reservoir fluid received from the wellbore via a fluid intake by the first gas separator to the second gas separator via the first liquid-phase discharge port of the first cross-over. At block 806, the method 800 comprises mixing by the second gas separator the portion of the first reservoir fluid fed through the first liquid-phase discharge port to the second gas separator with a second reservoir fluid received by the second gas separator from the wellbore via the second gas-phase discharge port of the second cross-over to form a third reservoir fluid. In an embodiment, the third reservoir fluid comprises a mix of liquid-phase fluid and gas-phase fluid at least part of the time the ESP assembly operates in the wellbore.

At block 808, the method 800 comprises feeding the third reservoir fluid by the second gas separator via the second liquid-phase discharge port of the second cross-over to the third gas separator. At block 810, the method 800 comprises feeding a portion of the third reservoir fluid by the third gas separator via the third liquid-phase discharge port to the centrifugal pump assembly. At block 812, the method 800 comprises lifting by the centrifugal pump assembly the portion of the third reservoir fluid fed by the third gas separator via the third liquid-phase discharge port to the centrifugal pump assembly to a wellhead at a surface location.

In an embodiment, the second gas separator is configured to support a fluid flow rate in the range from 20 barrels per day to 6,000 barrels per day. In an embodiment, the third gas separator is configured to support a fluid flow rate in the range from 7,100 barrels per day to 50,000 barrels per day.

Figure 9:
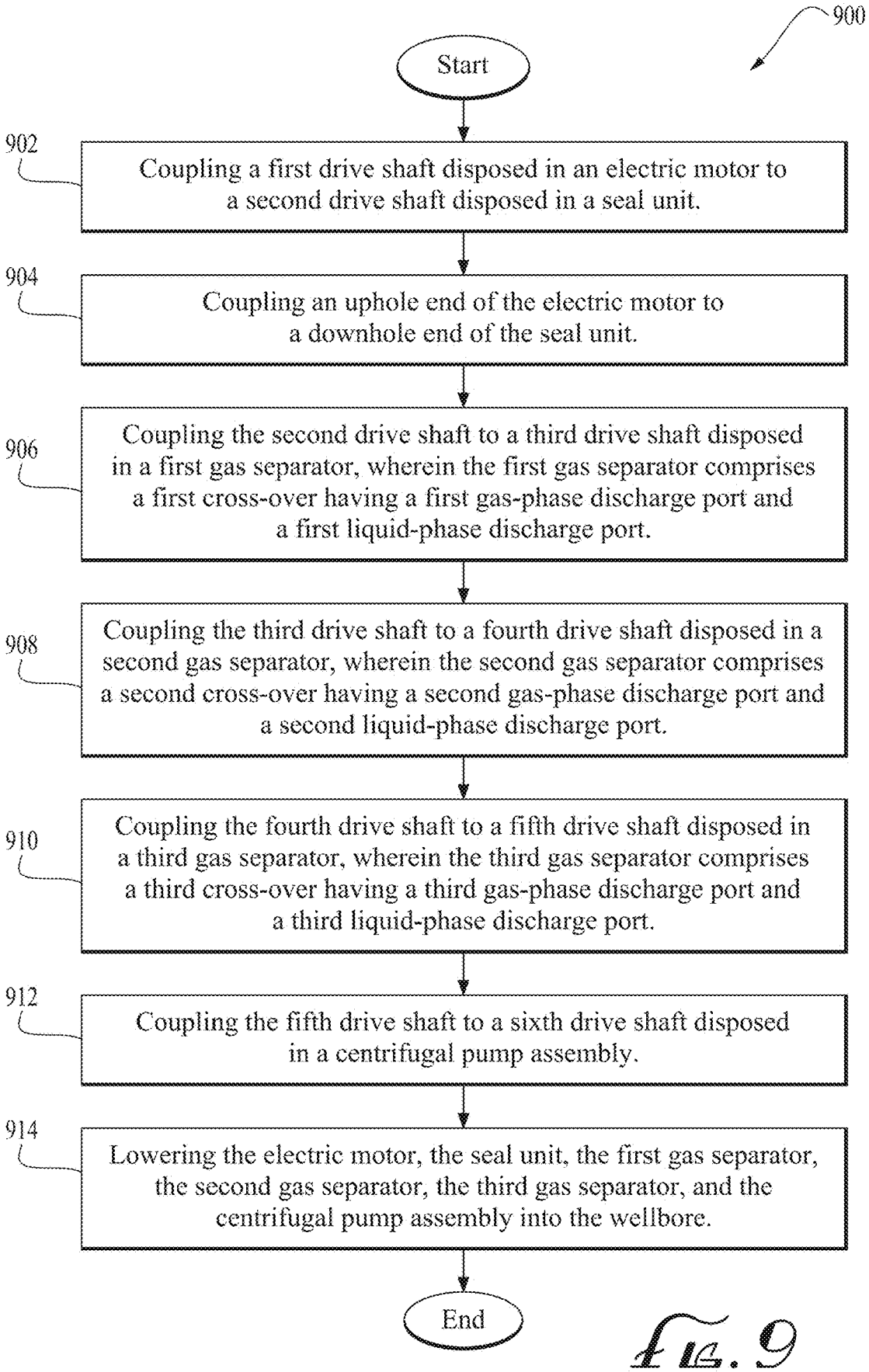
FIG. 9 is a flow chart of another method according to an embodiment of the disclosure.

Turning now to FIG. 9, a method 900 is described. In an embodiment, the method 900 is a method of assembling an electric submersible pump (ESP) assembly at a wellbore location. In an embodiment, the wellbore location is off-shore. In an embodiment, the wellbore location is on land. In an embodiment, the wellbore location is in-shore but in an interior body of water or marsh. In an embodiment, a wellbore at the wellbore location is a hydrocarbon production well. At block 902, the method 900 comprises coupling a first drive shaft disposed in an electric motor to a second drive shaft disposed in a seal unit.

At block 904, the method 900 comprises coupling an uphole end of the electric motor to a downhole end of the seal unit. At block 906, the method 900 comprises coupling the second drive shaft to a third drive shaft disposed in a first gas separator, wherein the first gas separator comprises a first cross-over having a first gas-phase discharge port and a first liquid-phase discharge port.

At block 908, the method 900 comprises coupling the third drive shaft to a fourth drive shaft disposed in a second gas separator, wherein the second gas separator comprises a second cross-over having a second gas-phase discharge port and a second liquid-phase discharge port. At block 910, the method 900 comprises coupling the fourth drive shaft to a fifth drive shaft disposed in a third gas separator, wherein the third gas separator comprises a third cross-over having a third gas-phase discharge port and a third liquid-phase discharge port.

At block 912, the method 900 comprises coupling the fifth drive shaft to a sixth drive shaft disposed in a centrifugal pump assembly. At block 914, the method 900 comprises lowering the electric motor, the seal unit, the first gas separator, the second gas separator, the third gas separator, and the centrifugal pump assembly into the wellbore. In an embodiment, lowering the electric motor, the seal unit, the first gas separator, the second gas separator, the third gas separator, and the centrifugal pump assembly into the wellbore comprises hanging the electric motor, the seal unit, the first gas separator, the second gas separator, the third gas separator, and the centrifugal pump assembly from a production tubing and above a horizontal portion of the wellbore In an embodiment, the method 900 further comprising setting a packer in the wellbore above the centrifugal pump assembly, wherein the packer seals against an inside of the wellbore and against an outside of the production tubing. In an embodiment, the method 900 further comprises adjusting an adjustable opening of the second gas-phase discharge port of the second cross-over.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, RI, and an upper limit, Ru, is disclosed, any number falling within the range is specifically disclosed. In particular, the following numbers within the range are specifically disclosed: R=RI+k*(Ru−RI), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. An electric submersible pump (ESP) assembly, comprising:

an electric motor having a first drive shaft;

a seal unit having a second drive shaft coupled to the first drive shaft of the electric motor and disposed uphole of the electric motor;

a first gas separator having a third drive shaft coupled to the second drive shaft and disposed uphole of the seal unit, wherein the first gas separator comprises a first cross-over, wherein the first cross-over defines a first gas phase discharge port and a first liquid phase discharge port;

a second gas separator having a fourth drive shaft coupled to the third drive shaft and disposed uphole of the first gas separator, wherein the second gas separator comprises a second cross-over, wherein the second cross-over defines a second gas phase discharge port and a second liquid phase discharge port;

a third gas separator having a fifth drive shaft coupled to the fourth drive shaft and disposed uphole of the second gas separator, wherein the third gas separator comprises a third cross-over, wherein the third cross-over defines a third gas phase discharge port and a third liquid phase discharge port, wherein the first gas separator is rated to have a first fluid flow rate, the second gas separator is rated to have a second fluid flow rate, the third gas separator is rated to have a third fluid flow rate, and the second fluid flow rate is less than or equal to 85% of the first fluid flow rate and less than or equal to 85% of the third fluid flow rate; and a centrifugal pump assembly having a sixth drive shaft coupled to the fifth drive shaft and disposed uphole of the third gas separator, wherein the centrifugal pump assembly comprises a plurality of centrifugal pump stages and wherein each centrifugal pump stage comprises an impeller coupled to the sixth drive shaft and a diffuser retained by a housing of the centrifugal pump assembly.

2. The ESP assembly of claim 1, wherein the first gas separator comprises:

a first fluid mover mechanically coupled to the third drive shaft and having a fluid inlet and a fluid outlet;

a fluid reservoir concentrically disposed around the third drive shaft and located uphole of the first fluid mover, wherein an inside surface of the fluid reservoir and an outside surface of the third drive shaft define a first annulus that is fluidically coupled to the fluid outlet of the first fluid mover;

a second fluid mover having a fluid inlet and a fluid outlet, wherein the second fluid mover is located uphole of the fluid reservoir, and wherein the fluid inlet of the second fluid mover is fluidically coupled to the first annulus;

a separation chamber concentrically disposed around the third drive shaft and located uphole of the second fluid mover and downhole of the first cross-over, wherein an inside surface of the separation chamber and the outside surface of the third drive shaft define a second annulus that is fluidically coupled to the fluid outlet of the second fluid mover and is fluidically coupled to the first gas phase discharge port and to the first liquid phase discharge port.

3. The ESP assembly of claim 2, wherein the first annulus is a portion of the fluid reservoir that does not enclose a radial support of the third drive shaft, wherein when the third drive shaft is about 0.6875 inches in diameter, the first annulus has a volume of at least 70 cubic inches and less than 100 cubic inches; wherein when the third drive shaft is about 0.875 inches in diameter, the first annulus has a volume of at least 85 cubic inches and less than 120 cubic inches; wherein when the third drive shaft is about 1.0 inches in diameter, the first annulus has a volume of at least 180 cubic inches and less than 250 cubic inches; and wherein when the third drive shaft is about 1.1875 inches in diameter, the first annulus has a volume of at least 220 cubic inches and less than 300 cubic inches.

4. The ESP assembly of claim 3, wherein the fluid reservoir is at least 6 inches long and less than 17 inches long.

5. The ESP assembly of claim 1, wherein the first fluid flow rate is greater than 7,100 barrels per day and less than 50,000 barrels per day.

6. The ESP assembly of claim 5, wherein the second fluid flow rate is less than 6,000 barrels per day and greater than 20 barrels per day.

7. The ESP assembly of claim 1, further comprising a production tubing uphole of the centrifugal pump assembly and fluidically coupled to an outlet of the centrifugal pump assembly and a packer disposed around the production tubing.

8. A method of lifting reservoir fluid by an electric submersible pump (ESP) assembly, comprising:

placing an electric submersible pump (ESP) assembly in a wellbore, wherein the ESP assembly comprises an electric motor, a seal unit disposed uphole of the electric motor, a first gas separator disposed uphole of the seal unit and having a first cross-over that comprises a first gas-phase discharge port and a first liquid-phase discharge port, a second gas separator disposed uphole of the first gas separator and having a second cross-over that comprises a second gas-phase discharge port and a second liquid-phase discharge port, a third gas separator disposed uphole of the second gas separator and having a third cross-over that comprises a third gas-phase discharge port and a third liquid-phase discharge port, and a centrifugal pump assembly disposed uphole of the third gas separator;

feeding a portion of a first reservoir fluid received from the wellbore via a fluid intake by the first gas separator to the second gas separator via the first liquid-phase discharge port of the first cross-over;

mixing by the second gas separator the portion of the first reservoir fluid fed through the first liquid-phase discharge port to the second gas separator with a second reservoir fluid received by the second gas separator from the wellbore via the second gas-phase discharge port of the second cross-over to form a third reservoir fluid;

feeding the third reservoir fluid by the second gas separator via the second liquid-phase discharge port of the second cross-over to the third gas separator;

feeding a portion of the third reservoir fluid by the third gas separator via the third liquid-phase discharge port to the centrifugal pump assembly; and lifting by the centrifugal pump assembly the portion of the third reservoir fluid fed by the third gas separator via the third liquid-phase discharge port to the centrifugal pump assembly to a wellhead at a surface location.

9. The method of claim 8, wherein the second gas separator is configured to support a fluid flow rate in the range from 20 barrels per day to 6,000 barrels per day.

10. The method of claim 9, wherein the third gas separator is configured to support a fluid flow rate in the range from 7,100 barrels per day to 50,000 barrels per day.

11. The method of claim 8, wherein placing the ESP assembly in the wellbore comprises lowering the ESP assembly into the wellbore by a production tubing that connects to a discharge disposed at an uphole end of the centrifugal pump, further comprising setting a packer in the wellbore, wherein the packer seals against an inside of the wellbore and against an outside of the production tubing.

12. The method of claim 8, wherein the second gas-phase discharge port of the second cross-over is adjustable.

13. The method of claim 8, wherein the third reservoir fluid comprises a mix of liquid-phase fluid and gas-phase fluid at least part of the time the ESP assembly operates in the wellbore.

14. A method of assembling an electric submersible pump (ESP) assembly at a wellbore location, comprising:

coupling a first drive shaft disposed in an electric motor to a second drive shaft disposed in a seal unit;

coupling an uphole end of the electric motor to a downhole end of the seal unit;

coupling the second drive shaft to a third drive shaft disposed in a first gas separator, wherein the first gas separator comprises a first cross-over having a first gas-phase discharge port and a first liquid-phase discharge port;

coupling the third drive shaft to a fourth drive shaft disposed in a second gas separator, wherein the second gas separator comprises a second cross-over having a second gas-phase discharge port and a second liquid-phase discharge port;

coupling the fourth drive shaft to a fifth drive shaft disposed in a third gas separator, wherein the third gas separator comprises a third cross-over having a third gas-phase discharge port and a third liquid-phase discharge port, wherein the first gas separator is rated to have a first fluid flow rate, the second gas separator is rated to have a second fluid flow rate, the third gas separator is rated to have a third fluid flow rate, and the second fluid flow rate is less than or equal to 85% of the first fluid flow rate and less than or equal to 85% of the third fluid flow rate;

coupling the fifth drive shaft to a sixth drive shaft disposed in a centrifugal pump assembly; and lowering the electric motor, the seal unit, the first gas separator, the second gas separator, the third gas separator, and the centrifugal pump assembly into the wellbore.

15. The method of claim 14, wherein the wellbore location is offshore.

16. The method of claim 14, wherein the wellbore location is on land.

17. The method of claim 14, wherein lowering the electric motor, the seal unit, the first gas separator, the second gas separator, the third gas separator, and the centrifugal pump assembly into the wellbore comprises hanging the electric motor, the seal unit, the first gas separator, the second gas separator, the third gas separator, and the centrifugal pump assembly from a production tubing and above a horizontal portion of the wellbore.

18. The method of claim 17, further comprising setting a packer in the wellbore above the centrifugal pump assembly, wherein the packer seals against an inside of the wellbore and against an outside of the production tubing.

19. The method of claim 14, wherein the wellbore is a hydrocarbon production well.

20. The method of claim 14, further comprising adjusting an adjustable opening of the second gas-phase discharge port of the second cross-over.

* * * * *